US006135335A

United States Patent [19]

Shoemaker, Jr.

[11] Patent Number: 6,135,335

[45] Date of Patent: Oct. 24, 2000

[54] TICKET DISPENSER WITH GUIDE FOR ACCOMMODATING TICKETS OF REDUCED THICKNESS AND VARYING WIDTHS

[75] Inventor: Stephen P. Shoemaker, Jr., Redondo Beach, Calif.

[73] Assignee: Wedges/Ledges, Redondo Beach, Calif.

[21] Appl. No.: 09/351,404

[22] Filed: Jul. 9, 1999

Related U.S. Application Data

[63] Continuation-in-part of application No. 09/328,052, Jun. 8, 1999.

[51] Int. Cl.[7] ..... B65H 23/18

[52] U.S. Cl. ..... 226/39; 226/144; 226/45

[58] Field of Search ..... 226/144, 154, 226/152, 156, 33, 39, 43; 242/615.3

[56] References Cited

U.S. PATENT DOCUMENTS

| | | | |
|---|---|---|---|
| 2,061,389 | 11/1936 | Soltz | 226/183 X |
| 3,097,777 | 7/1963 | Floyd | 226/39 |
| 4,033,494 | 7/1977 | Middleton et al. | 226/156 X |
| 4,060,177 | 11/1977 | Surber, Jr. | 226/156 X |
| 4,086,833 | 5/1978 | Austin, Jr. | 226/156 X |
| 4,185,548 | 1/1980 | Pierce, Jr. et al. . | |
| 4,690,344 | 9/1987 | Yokota | 226/156 X |
| 4,757,931 | 7/1988 | Murasaki | 242/615.3 X |
| 5,113,758 | 5/1992 | Chou | 226/156 X |
| 5,503,318 | 4/1996 | Chou | 226/144 |
| 5,695,107 | 12/1997 | Shoemaker, Jr. . | |

*Primary Examiner*—Donald P. Walsh
*Assistant Examiner*—Collin A. Webb
*Attorney, Agent, or Firm*—Hickman Coleman & Hughes, LLP

[57] ABSTRACT

A ticket dispensing apparatus is provided including a framework having a driver roller rotatably coupled to the framework to dispense tickets therefrom. Also included is a sensor for monitoring the dispensing of the tickets. A motor is coupled to the drive roller and in communication with the sensor to rotate the drive roller and thereby advance the tickets. Further coupled to the framework is a support for supporting the tickets. For maintaining the tickets in operational relationship with the sensor and the drive roller, at least one guide is coupled to the support. In use, the guide is adjustable to accommodate tickets of varying widths. Also, the guide is substantially rigid in order to avoid bending the tickets.

23 Claims, 3 Drawing Sheets

TICKET DISPENSER WITH GUIDE FOR ACCOMMODATING TICKETS OF REDUCED THICKNESS AND VARYING WIDTHS

CROSS-REFERENCE TO RELATED APPLICATIONS

This application is a continuation-in-part of an application entitled "TICKET DISPENSER" filed Jun. 8, 1999 under U.S. application Ser. No. 09/328,052 and which is incorporated herein by reference in its entirety. The present application is further related to U.S. Pat. No. 5,695,107; U.S. application Ser. No. 08/871,852 filed Jun. 4, 1997; U.S. application Ser. No. 09/264,218 filed Mar. 5, 1999; and U.S. application Ser. No. 09/193,376 filed Nov. 17, 1998, which are each incorporated herein by reference in their entirety.

BACKGROUND OF THE INVENTION

1. Field of the Invention

This invention relates to ticket dispensing machines and more particularly to redemption ticket dispensing machines for arcade games.

2. Background of the Related Art

Ticket and stamp dispensing machines are used for in a variety of applications. The tickets, stamps, etc. are typically supplied in the form of a fan fold or a large roll and are dispensed one or more at a time.

One representative use of the machine of the invention is to associate it with a coin operated system which will give the ticket dispensing machine a signal to dispense tickets. Upon insertion of a proper coin, a power unit such as an electric motor will be energized by the ticket dispenser control system to thereby operate the machine to advance one or more tickets to the outside of the machine.

Another application of a ticket dispenser is in conjunction with a redemption game apparatus so that when a predetermined score or other condition is reached, the ticket dispenser will automatically dispense a suitable number of tickets. These tickets can then be removed from the game apparatus and redeemed for prizes.

An example of such a redemption ticket apparatus of the prior art is shown in Prior Art FIG. 1. More information on the machine of Prior Art FIG. 1 can be found with reference to U.S. Pat. No. 4,272,001 to Horniak which is incorporated herein by reference in its entirety. As shown, a ticket dispensing apparatus 1 includes an idler roller 2, a fixed framework 3 in which the idler roller 2 is rotatably mounted, and a drive roller 4 disposed to press tickets against the idler roller 2. Controllable power means 5 is connected to the drive roller 4 to rotate it and thereby advance tickets between it and the idler roller 2.

In use, the controllable power means 5 employs an electronic eye 6, or any type of sensor, to monitor movement of the tickets. This is accomplished by sensing cut outs in side edges of the tickets. Deep notches 7 are formed in side plates 8 of the framework 3 to make it possible for a leaf spring 9 to apply a side pressure to the tickets opposite the electronic eye 6. Such lateral pressure urges the tickets against the opposite side plate adjacent the electronic eye 6. The notches 7 in the side plates 8 thus permit the spring 9 to bear on the tickets and make sure that the tickets move in a fixed path past electronic eye 6 which senses the cut outs in the tickets, in a conventional manner.

The Horniac invention works well for relatively thick tickets that are commonly composed of rigid cardboard which commonly has a thickness of 8.7 thousandths of an inch or 110 lb. However, it would not work well for thin tickets or stamps, which would tend to tear or become misaligned. This is due, in part, to the lateral pressure exerted by the spring 9 or its equivalent. In apparatuses such as that shown in Prior Art FIG. 1, thin tickets would be prone to collapsing under the pressure of the spring 9 thus causing jamming and other problems. Further, due to the nature of the spring 9, the Horniac invention is merely capable of effectively accommodating tickets of a single width.

Further examples of prior art ticket dispensers can be found in U.S. Pat. No. 3,627,183 to V. Mason, U.S. Pat. No. 2,657,750 to C. F. Webb, U.S. Pat. No. 2,219,650 to R. H. Helsel, and U.S. Pat. No. 3,280,678 to W. T. Shackelford.

SUMMARY OF INVENTION

A ticket dispensing apparatus is provided including a framework having a driver roller rotatably coupled to the framework to dispense tickets therefrom. Also included is a sensor for monitoring the dispensing of the tickets. A motor is coupled to the drive roller and in communication with the sensor to rotate the drive roller and thereby advance the tickets.

Further coupled to the framework is a support for supporting the tickets. For maintaining the tickets in operational relationship with the sensor and the drive roller, at least one guide is coupled to the support. In use, the guide may be adjustable to accommodate tickets of different varying widths.

Further, the guide is substantially rigid in order to avoid bending the tickets. This is particularly beneficial when the present invention is used with tickets having a reduced thickness. Such tickets are conventionally flimsy and subject to collapse when lateral pressure is applied. The present invention thus overcomes this problem by avoiding the assertion of any lateral pressure on the tickets.

In addition to the foregoing features, a spring may be mounted on the framework in order to apply pressure against the support with the tickets therebetween. Optionally, an adjustment screw may be employed to vary such pressure. This affords a custom frictional force in a direction opposite a direction of movement of the tickets during dispensing. Again, this is particularly beneficial in the case of thin tickets since it is important to keep the tickets substantially taut during use in order to avoid jamming and the like.

These and other advantages of the present invention will become apparent to those skilled in the art after reading the following descriptions and studying the various figures of the drawings.

DETAILED DESCRIPTION OF THE PREFERRED EMBODIMENTS

Figure 4:
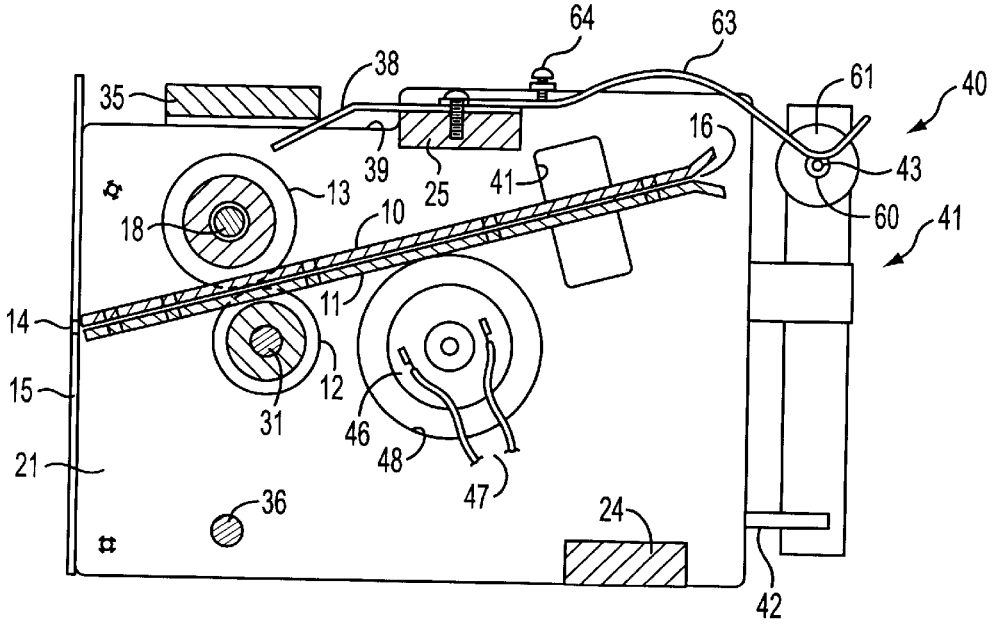
FIG. 4 is a section on the line 4—4 of FIG. 3.

Generally considered, as is shown in FIG. 4, the strip of tickets to be dispensed is fed through the passageway between 10, the top guide plate and the bottom guide plate 11. The ticket strip is advanced by the drive roller 12 and the idler roller 13, and it is ejected through the slot 14 in the front framework plate 15. The strip of tickets may be in the form of a roll or be layered back and forth on itself as is now practiced in this art. Its leading end is inserted between the flared entrance ends at 16 between the guide plates 10 and 11 and is advanced until the end reaches the front plate 15. It should be noted that in the present description, tickets may refer to any like items, i.e. stamps, paper pieces, etc.

Figure 7:
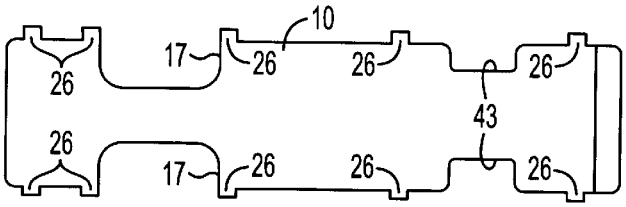
FIG. 7 is a plan view of one of the guide plates which form the passageway for the strip of tickets.

To facilitate the passage of the ticket strip between the rollers 12 and 13 when the machine is being initially loaded, they are slightly separated by hand pressure. Normally, the drive roller 12 is spring biased toward the idler roller 13, so that they frictionally press on the tickets. To permit this contact between the rollers, the guide plates 12 and 13 are formed at the edges with the cut-away notches 17 as is shown in FIG. 7.

The idler roller 13 is rotatably mounted on a shaft 18 the ends of which are bearinged in the two framework plates 20 and 21, which are spaced parallel to each other. The shaft 18 may be held against endwise displacement by conventional C-clips (not shown) or any other common means and this is true of the other shafts to be hereinafter mentioned. It does not matter whether the free rotation of the roller 13 is on the shaft 18 or this is due to rotation of the shaft in its bearings in the framework side plates 20 and 21. Washers (not shown) may be located between the roller 13 and the side plates to serve as spacers.

The roller 13 is centrally and annularly cut away at 22 so that the roller proper is constituted by the end hub-like enlargements. This annular groove 22 admits the location of the guide plates as is shown in FIG. 4; this figure also shows the tangential positioning of the guide plates relative to the point of contact between the rollers.

The side frame plates 20 and 21 are held in their spaced relationship by welding 23 or other suitable attachment to the front plate 15. A lower spacer block 24 and an upper spacer block 25 are fastened between the side plates as by the screws which are shown, to further form a rigid frame. The guide plates 10 and 11 are as wide as the space between the side plates 20 and 21 and are held in place by the small projections 26 which enter correspondingly located holes in the side plates.

The drive roller 12 has a central portion of reduced diameter like that of the idler roller 13 so that the end portions are of enlarged hub-like formation. Their surfaces are knurled as shown at 27 or are otherwise roughened to provide a frictional surface to present to the ticket strip. A groove 28 is formed about centrally of the knurled surfaces and in each groove is an O-ring 29 of rubber or like plastic material. It is this O-ring which normally frictionally advances the ticket strip.

Figure 5:
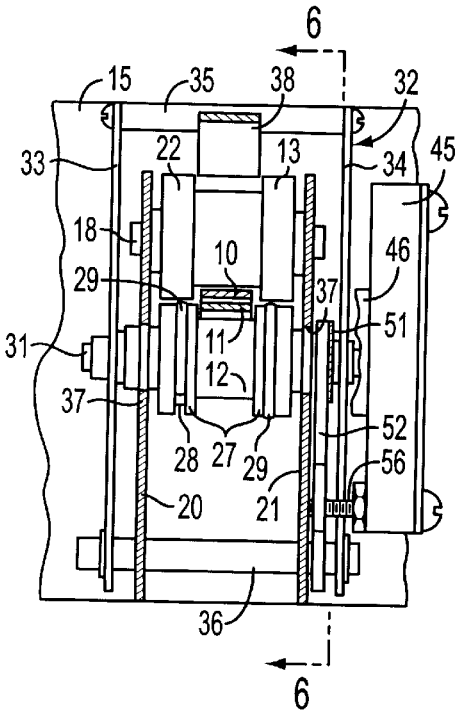
FIG. 5 is a section on the broken line 5—5 of FIG. 3.

The drive or power roller 12 is affixed as by a set screw (not shown) to a shaft 31 which is mounted for slight movement toward and away from the idler shaft 18 while maintaining their parallelism. To accomplish this the shaft 31 is bearinged in a swinging yoke frame 32 of inverted U-shape as is best shown in FIG. 5. This U-frame is made up of the two parallel side bands or strips 33 and 34 and the top spacer block 35 to which they are firmly attached.

The frame 32 can swing or pivot about the pivot shaft 36 which passes through and is supported by the side plates 10 and 11. The side bands 33 and 34 do not have to be fastened to the pivot shaft 36. The side bands 33 and 34 lie on the outsides of the plates 20 and 21 and of course are clear of the ends of the idler shaft 18 as shown in FIG. 5. To allow the necessary free swing on the shaft 31, holes 37 are formed in the plates 20 and 21.

Figure 1:
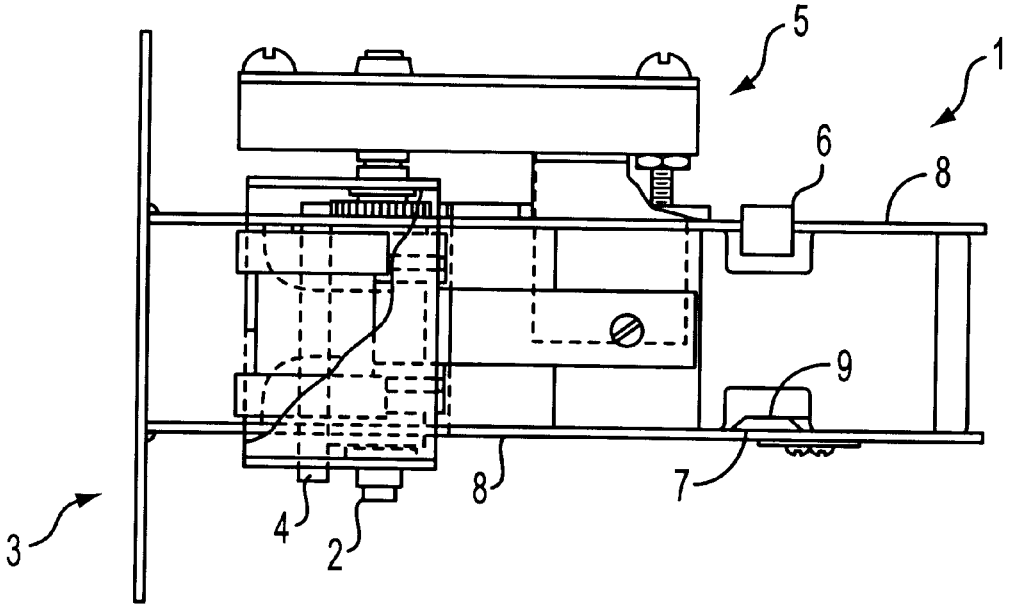
FIG. 1 (PRIOR ART)
FIG. 1 is a plan view of a ticket dispenser apparatus of the prior art.
Figure 2:
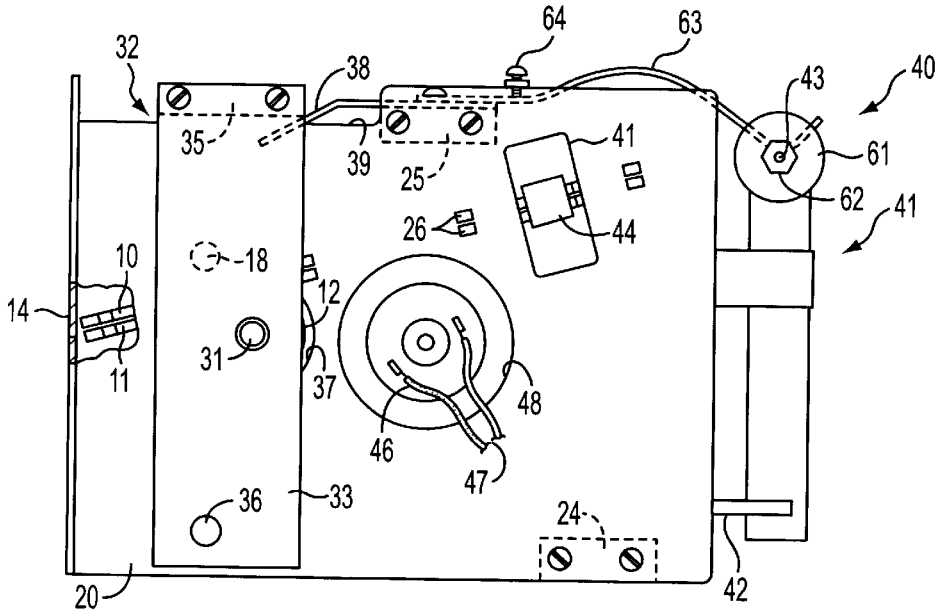
FIG. 2 is a side elevational view of the present invention showing a part of the front side plate being broken away.

To swing the frame 32 and thereby the drive roller in the general direction of movement of the tickets, a spring 38 is provided. This is a leaf spring which is fastened to the fixed frame block 25 and which bears at its free end against the yoke block 35. As is shown in FIGS. 2 and 4 this tends to turn the yoke frame in a counterclockwise direction.

As is clear from FIG. 4 the disposition of the drive roller 12 is such that under the biasing action of spring 38 the roller 12 abuts against the idler roller 13 and this is an important feature of the invention as will be explained in a subsequent description of the operation of the machine. At this point it should be noted that the roller 12 is on the ticket supply side of roller 13 and that the roller 12 cannot pass under and forward of the roller 13. Stated differently, the drive roller 12 is located on the ticket supply side of a plane passing through the axis of pivot shaft 36 and through the axis of idler shaft 18. To accommodate the yoke spacer block 35 the top edges of side plates 20 and 21 are reduced in height as is indicated at 39.

Figure 3:
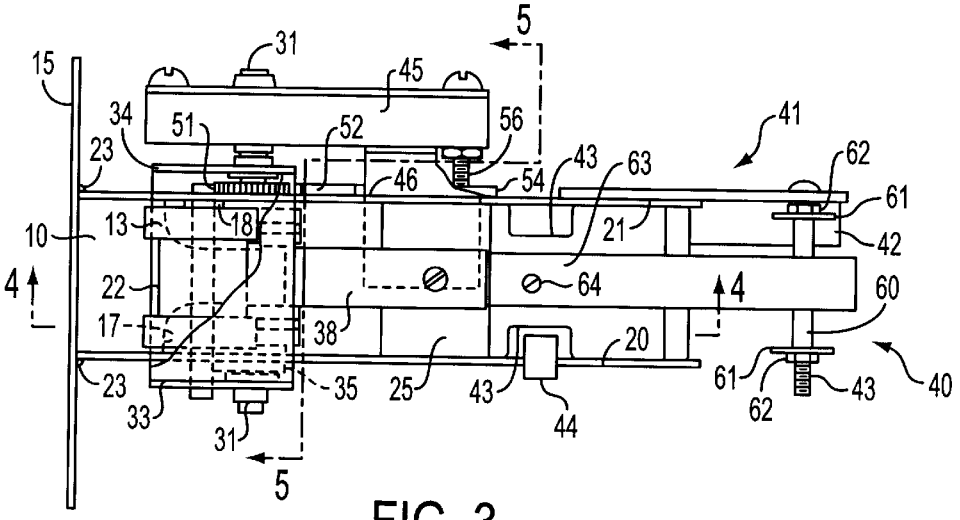
FIG. 3 is a plan view of the present invention showing a portion of a top spacer plate and a portion of the motor being broken away to show underlying structure.

Further coupled to the framework side plates 20 and 21 is an auxiliary support 40 for supporting the tickets. As shown in FIGS. 2–4, the auxiliary support 40 is coupled to one of the framework side plates 20 and 21 by way of an arm 41. As shown, the arm includes a horizontal portion screwably coupled to one of the framework side plates 20 and 21 and a vertical portion coupled at a central extent thereof to an end of the horizontal portion. A bottom end of the vertical portion of the arm 41 has an extension 42 for abutting an end edge of one of the framework side plates 20 and 21 to the which the arm 41 is coupled.

The support 40 further includes a bolt 43 screwably coupled in a threaded bore formed in a top end of the vertical portion of the arm 41. The support 40 is thus positioned in perpendicular relationship with the vertical portion of the arm 41 and resides at an elevation substantially common with that of an electronic eye 44. As mentioned earlier, the present invention employs the electronic eye 44, or any type of sensor, to monitor movement of the tickets.

Such monitoring of the movement of the tickets may accomplished by sensing markings such as cut outs in side edges of the tickets. For example, the electronic eye 44 may comprise a transmitter portion and a receiver portion which communicate only when one of the cut outs is positioned therebetween. As an option, the electronic eye 44 may be adjusted to accommodate varied placement of the cut outs on the tickets. Such placement may vary based on a width of the tickets or any other factor. In alternate embodiments, the electronic eye 44 may be adapted to sense any other type of markings, i.e. bar code, lines, color differentials, etc., on the tickets in order to accomplish the objective of monitoring the dispensing of the tickets. Given tickets of a sufficient thinness, the electronic eye 44 may also be capable of reading therethrough for detecting markings of some sort.

As shown in FIG. 3, a sleeve 60 with a substantially smooth outer surface is positioned on the bolt 43 of the support 40. Mounted on opposite sides of the sleeve 60 is a pair of guides 61 which, in one embodiment, may each take the form of an annular washer. The guides 61 may be fixed with respect to the sleeve 60 using a pair of nuts 62. It is thus apparent that tickets of any length and varying widths may be accommodated by adjusting a length of the sleeve 60 or merely aligning one of the guides 61 with the electronic eye 44. It should be noted that in various alternate embodiments, the guides may take any form and may be connected to the framework in any way that accomplishes the intended result of guiding the tickets without collapsing the same.

In order to maintain the tickets taut, a spring 63 may be provided having a first end coupled to the upper spacer block 25 and a second end in abutment with the sleeve 60 of the support 40. The spring 63 thus serves for pressing the tickets against the support 40 to afford a frictional force in a direction opposite a direction of movement of the tickets during dispensing. As an option, the second end of the spring 63 may have a substantially arcuate configuration. Further, an adjustment screw 64 may be employed to vary a magnitude of the frictional force to accommodate tickets of different thickness and strengths.

In use, the support 40 serves for maintaining the tickets in operational relationship with the electronic eye 44 and the drive roller 12 by centering the same. Further, the guides 61 are adjustable to accommodate tickets of varying widths. Ideally, the guide 61 is substantially rigid to the extent of preventing the tickets from being bent. This is particularly beneficial during use of the present invention with thinner tickets (or like items) having a reduced thickness. Such thinner tickets are conventionally constructed from a flimsy waxed, glossy, or plain paper material which commonly has a thickness of 3.9–4.2 thousandths of an inch or 20 lb. Bond/60 lb. book.

The drive shaft 31 is long enough to extend through a gear reduction box 45 which it thereby supports. To this gear box is secured an electric motor 46 having the supply wires 47; this is generally a 100 RPM, 12 volt DC motor but other ones may be used. The gear reduction box 45 serves to reduce the drive shaft speed so that the drive roller 12 turns at a few RPM in advancing the tickets. The motor 46 extends into the interior of the machine through a hole 48 in the side plate as this locates the motor in an otherwise unoccupied space and gets it out of the way. The drive shaft 31, of course, turns freely in the housing of the gear box 45 when the motor is driving it.

To stop the rotation of drive shaft 31 when the motor is not turning it, a ratchet gear 51 is affixed to it and for convenience it is located between the yoke frame band 34 and the side plate 21 as is shown in FIGS. 3 and 4. A pawl lever 52 is freely rotatable on the pivot shaft 36 and it has a pointed end 53 which can engage the teeth on the ratchet wheel 51; when so engaged the shaft 31 and drive roller 12 cannot turn in the direction which will advance the tickets to the slot opening 14.

Figure 6:
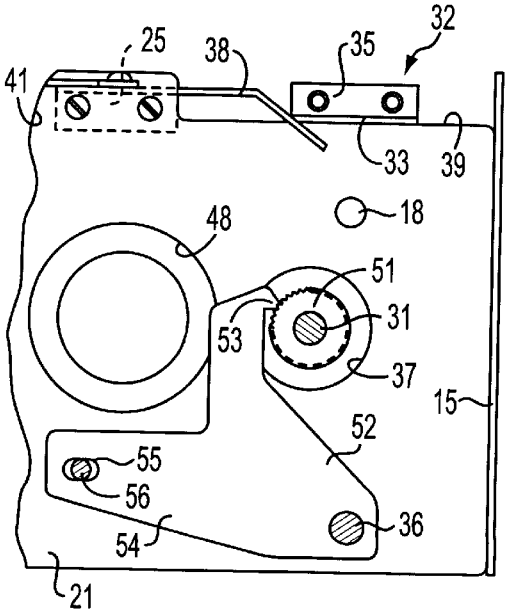
FIG. 6 is an elevational view on the line 6—6 of FIG. 5, showing the side opposite from that of FIG. 2, the left hand portion of the side plate being broken away.

The pawl lever 52 has a lateral extension 54 away from front plate 15 and there is an elongated slot 55 through it. Projecting into this slot 55 is a bolt or pin 56 which is carried by the overlying portion of the gear box 45. If this gear box, which is mounted on the drive shaft 31 is turned in a clockwise direction, viewed from the side of FIG. 6, the pin 56 will lift the extension 54 with it and turn the engaging end 53 against the ratchet gear 51 to thereby lock roller 12 against turning in a clockwise direction as viewed in FIG. 6.

When the electric motor 46 is energized to turn the drive shaft 31 in a clockwise direction (as viewed in FIG. 6) the reverse reaction torque on the gear box tends to turn the gear box in a counterclockwise direction. The consequent downward movement of pin 56 will serve to turn the pawl lever 52 so that its pointed end 53 will be withdrawn away from the ratchet wheel 51 and the drive shaft 31 will freely turn under the power of the electric motor.

In the operation of the machine, when the electric motor is energized the drive roller 12 will bear on the ticket which is between it and the idler roller and advance it to the delivery slot 14. In this manner one or more tickets will be moved out of the machine, depending on the machine set up. It is most likely that a sensing device of conventional structure will count the tickets being issued and to shut off the motor; such a sensing unit may involve a photo-electric cell for instance.

Only the issued tickets, of course, should be torn off. If, however, the exposed ticket is pulled on in an effort to withdraw additional tickets through the rollers, this action will only serve to bind the tickets more tightly so that no additional one can be pulled out of the machine. Such pulling action will pull the drive roller closer toward the idler roller and this will serve to compress the yieldable O-rings 29 so that the knurled surfaces come up against the tickets to grip them even more frictionally and firmly.

This slight rotation of the drive roller 12 will rotate the drive shaft 31 enough to also rotate the gear box 45 so that its pin 56 lifts the pawl lever 52 and engages its locking end 53 in the ratchet gear 51. This positively stops rotation of the drive shaft 31 and thereby the drive roller 12 so that the latter cannot be rotated. This, coupled with the strong frictional pressure of the knurled surfaces against the ticket strip prevents any slippage of the tickets between the rollers.

When the motor is next energized this reverse torque action explained above releases this strong gripping action so that the O-rings 29 take over to advance the ticket strip. When the current to the motor is cut off it is usual to bring it to an instant stop to prevent a ticket override by momentarily applying a reverse polarity. The high gear ratio assists in this and this frictional resistance in the gear train transmits the turning torque due to a manual pull on the tickets through the gear box so that its pin 56 is moved upwardly and dog end 53 engages sprocket 51.

The drawings which accompany this specification are a full scale representation of a ticket dispenser which is fully reliable and functional. They may be used as working drawings for the manufacture of an apparatus of this same size and dimensions; it will possess the several features and advantages asserted above. Variations from these exact dimensions and measurements can obviously be made but the percentage changes and the changes themselves cannot be exactly defined because of the several variables which are involved.

The rollers can each be made larger or smaller, the distance from the axis of 36 to the axis of 18 can be longer or shorter, the distance from the axis of 36 to the axis of 31 can be more or less and the thickness of the tickets are factors which may be varied from the measurements shown. It can be said that the distance from the axis of 36 to the axis of 31 plus the radius of the knurled surface of the drive roller, should be only a few or a small percent greater than the distance from the axis of 36 to the axis of 18 minus the radius of the idler roller.

The exact changes cannot be exactly set forth but in functional and empirical terms it can be said that the rollers must not touch so lightly that they can be jammed against each other and will not become released when power is applied. Nor can the rollers be so close together that they will not effectively grip the tickets when the ticket is manually pulled. These limits can easily be determined in practice.

What is claimed is:

1. A ticket dispensing apparatus comprising:

a framework;

a driver roller rotatably coupled to the framework to dispense tickets from the framework;

a sensor for monitoring the dispensing of the tickets;

a motor coupled to the drive roller and in communication with the sensor to rotate the drive roller and thereby advance the tickets;

at least one guide coupled to the framework for maintaining the tickets in operational relationship with at least one of the sensor and the drive roller, the guide being adjustable to accommodate tickets of varying widths;

a frame movable relative to the framework and in which the drive roller is rotatably mounted; and;

a support between the movable frames and the framework directing the movement of the movable frame so the axis of the driven roller moves in a path which is inclined toward and intersects the path of movement of the tickets on the delivery side away from the rollers.

2. A ticket dispensing apparatus as set forth in claim 1, wherein the at least on guide is coupled to the framework via a guide support.

3. A ticket dispensing apparatus as set forth in claim 2, wherein the guide support includes a threaded member and the guide is adjustably positioned thereon.

4. A ticket dispensing apparatus as set forth in claim 3, wherein the guide is adjusted by way of at least one nut.

5. A ticket dispensing apparatus as set forth in claim 4, wherein the guide is an annular washer.

6. A ticket dispensing apparatus as set forth in claim 3, and further including a sleeve with a substantially smooth outer surface positioned on the support.

7. A ticket dispensing apparatus as set forth in claim 2, and further including a spring having a first end coupled to the framework and a second end for pressing the tickets against the support to afford a frictional force in a direction opposite a direction of movement of the tickets during dispensing.

8. A ticket dispensing apparatus as set forth in claim 7, wherein the second end of the spring has a substantially arcuate configuration.

9. A ticket dispensing apparatus as set forth in claim 7, wherein the spring has an adjustment member for selectively varying a magnitude of the frictional force.

10. A ticket dispensing apparatus as recited in claim 1 further comprising a bias member which bears on the movable frame to urge the drive roller toward the idler roller to bear on the ticket between the rollers.

11. A method for guiding tickets in a ticket dispensing apparatus comprising:

providing a framework having a driver roller rotatably coupled thereto to dispense tickets from the framework, a sensor for monitoring the dispensing of the tickets, and a motor coupled to the drive roller and in communication with the sensor to rotate the drive roller and thereby advance the tickets;

maintaining the tickets in operational relationship with at least one of the sensor and the drive roller by way of a guide;

adjusting the guide to accommodate tickets of varying widths;

providing a frame movable relative to the framework and in which the drive roller is rotatably mounted; and a support between the movable frames and the framework directing the movement of the movable frame so the axis of the driven roller moves in a path which is inclined toward and intersects the path of movement of the tickets on the delivery side away from the rollers.

12. A method as set forth in claim 11, and further comprising constraining lateral movement of the tickets with a pair of guides.

13. A method as set forth in claim 11, wherein the guide is adjusted by way of a threaded coupling.

14. A method as set forth in claim 11, and further comprising affording a frictional force in a direction opposite a direction of movement of the tickets during dispensing.

15. A method for guiding tickets in a ticket dispensing apparatus as recited in claim 10 further comprising providing a bias member which bears on the movable frame to urge the drive roller toward the idler roller to bear on the ticket between the rollers.

16. A ticket dispensing apparatus comprising:

a framework;

a driver roller rotatably coupled to the framework to dispense tickets from the framework;

a sensor for monitoring the dispensing of the tickets;

a motor coupled to the drive roller and in communication with the sensor to rotate the drive roller and thereby advance the tickets;

at least one guide coupled to the framework for maintaining the tickets in operational relationship with at least one of the sensor and the drive roller, wherein the guide is substantially rigid in order to avoid bending the tickets;

a frame movable relative to the framework and in which the drive roller is rotatably mounted; and;

a support between the movable frames and the framework directing the movement of the movable frame so the axis of the driven roller moves in a path which is inclined toward and intersects the path of movement of the tickets on the delivery side away from the rollers.

17. A ticket dispensing apparatus as set forth in claim 16, wherein the at least one guide is adjustable to accommodate tickets of varying widths.

18. A ticket dispensing apparatus as set forth in claim 16, wherein the guide is adjusted by way of a threaded coupling.

19. A method for guiding tickets in a ticket dispensing apparatus comprising:

providing a framework having a driver roller rotatably coupled thereto to dispenser tickets from the framework, a sensor for monitoring the dispensing of the tickets, and a motor coupled to the drive roller and in communication with the sensor to rotate the drive roller and thereby advance the tickets;

maintaining the tickets in operational relationship with at least one of the sensor and the drive roller with a guide that is substantially rigid in order to avoid bending the tickets;

providing a frame movable relative to the framework and in which the drive roller is rotatably mounted; and a support between the movable frames and the framework directing the movement of the movable frame so the axis of the driven roller moves in a path which is inclined toward and intersects the path of movement of the tickets on the delivery side away from the rollers.

20. A method as set forth in claim 19, and further comprising constraining lateral movement of the tickets with a pair of guides.

21. A method as set forth in claim 19, wherein the guide is adjusted by way of a threaded coupling.

22. A method as set forth in claim 19, and further comprising affording a frictional force in a direction opposite a direction of movement of the tickets during dispensing.

23. A ticket dispensing apparatus comprising an idler roller, a fixed framework in which the idler roller is rotatably mounted, a drive roller disposed to press tickets against the idler roller, controllable power means connected to the drive roller to rotate the drive roller and thereby advance tickets between it and the idler roller, a frame movable relative to the framework and in which the drive roller is rotatably mounted and which also disposes the drive roller on the side of the idler roller from which the tickets are supplied to the rollers, bias means which constantly bear on the movable frame to urge the drive roller toward the idler roller to constantly bear on the ticket between the rollers, support means between the movable frame and the framework directing the movement of the movable frame so the axis of the driven roller moves in a path which is inclined toward and intersects the path of movement of the tickets on the delivery side away from the rollers, the drive roller being located so that it cannot move past the idler roller in the direction of the ticket movement because it abuts against the idler roller, said positioning of the drive roller and the path of movement of its axis relative to the idler roller and ticket movement thereby causing a manual pull on the tickets to bring the drive roller firmly toward the idler roller and tightly grip the tickets against movement between the rollers, wherein at least one guide is coupled to the framework for maintaining the tickets in operational relationship with at least one of the sensor and the drive roller, wherein the guide is substantially rigid in order to avoid bending the tickets.

* * * * *